US009875599B2

(12) United States Patent
Onitsuka

(10) Patent No.: US 9,875,599 B2
(45) Date of Patent: Jan. 23, 2018

(54) OPERATION DEVICE AND PLAY MACHINE

(71) Applicant: OMRON Corporation, Kyoto-shi, Kyoto (JP)

(72) Inventor: Hiroyuki Onitsuka, Gifu (JP)

(73) Assignee: OMRON Corporation, Kyoto (JP)

( * ) Notice: Subject to any disclaimer, the term of this patent is extended or adjusted under 35 U.S.C. 154(b) by 184 days.

(21) Appl. No.: 14/735,458

(22) Filed: Jun. 10, 2015

(65) Prior Publication Data

US 2015/0363997 A1 Dec. 17, 2015

(30) Foreign Application Priority Data

Jun. 11, 2014 (JP) ..... 2014-120752

(51) Int. Cl.
*G07F 17/32* (2006.01)
*G07F 17/34* (2006.01)

(52) U.S. Cl.
CPC ..... *G07F 17/3211* (2013.01); *G07F 17/3209* (2013.01); *G07F 17/3216* (2013.01); *G07F 17/34* (2013.01)

(58) Field of Classification Search
CPC ..... G07F 17/3211; G07F 17/3209; G07F 17/3216; G07F 17/34
USPC ..... 463/32
See application file for complete search history.

(56) References Cited

U.S. PATENT DOCUMENTS 3,619,026 A * 11/1971 Cindrich ..... G03H 1/22 359/25
4,421,317 A * 12/1983 Hector ..... A63F 13/08 359/1
5,270,752 A * 12/1993 Kataoka ..... G03B 21/608 239/18
6,842,175 B1 * 1/2005 Schmalstieg ..... G06F 3/011 345/427
7,654,899 B2 * 2/2010 Durham ..... G07F 17/3202 312/7.2
9,477,317 B1 * 10/2016 Clements ..... G06F 3/017
2001/0030642 A1 * 10/2001 Sullivan ..... G06F 3/0421 345/157
2004/0001182 A1 * 1/2004 Dyner ..... G03B 21/608 353/28

(Continued)

FOREIGN PATENT DOCUMENTS

JP 2013-165759 A 8/2013
WO WO 2012020410 A2 * 2/2012 ..... G06F 3/017

OTHER PUBLICATIONS

Gary B. Shelly, Thomas J. Cashman, Misty E. Vermaat, Jeffrey J. Quasney et al. (2008). Discovering computers 2008: introductory. Boston, MA: Thomson/Course Technology. ISBN 1423912047, particularly page 103 (page 129 of PDF).*

(Continued)

*Primary Examiner* — Jason Skaarup
(74) *Attorney, Agent, or Firm* — Osha Liang LLP

(57) ABSTRACT

An operation device installed on a play machine has a push button switch having a push button made of a translucent material, a floating image projector that projects a floating image into midair above the push button through the push button from a rear face side of the push button, and a gesture detector in which at least a region where the floating image is projected is set to be a detection region.

6 Claims, 13 Drawing Sheets

(56) References Cited

U.S. PATENT DOCUMENTS

2005/0094103 A1* 5/2005 Robinson ..... G02B 17/0621 353/10
2008/0068225 A1* 3/2008 Wahlstrom ..... G06F 3/0238 341/22
2009/0021490 A1* 1/2009 Stickels ..... B64C 13/02 345/173
2009/0021946 A1* 1/2009 Nozaki ..... H04N 9/3176 362/296.01
2010/0120534 A1* 5/2010 Borissov ..... G07F 17/32 463/37
2010/0142016 A1* 6/2010 Cable ..... G03H 1/22 359/9
2010/0195055 A1* 8/2010 Maekawa ..... G02B 27/2292 353/10
2010/0321325 A1* 12/2010 Springer ..... G06F 3/041 345/174
2011/0111852 A1* 5/2011 Cohen ..... G07F 17/32 463/37
2011/0128555 A1* 6/2011 Rotschild ..... G02B 27/2271 356/625
2011/0212774 A1* 9/2011 Wudtke ..... G07F 17/3202 463/30
2011/0269543 A1* 11/2011 Johnson ..... A63F 13/08 463/37
2012/0306817 A1* 12/2012 Lin ..... G06F 3/0412 345/175
2013/0331184 A1* 12/2013 Kelly ..... G07F 17/3211 463/31
2013/0343607 A1* 12/2013 Wilf ..... G06F 3/017 382/103
2014/0111479 A1* 4/2014 Krah ..... G06F 3/0421 345/175
2014/0235320 A1* 8/2014 Kelly ..... G07F 17/3209 463/20
2014/0327747 A1* 11/2014 Kong ..... G02B 27/2292 348/51
2014/0354577 A1* 12/2014 Hanssen ..... G06F 3/044 345/174
2015/0024783 A1* 1/2015 Konno ..... G06F 17/3087 455/456.3
2015/0103011 A1* 4/2015 Large ..... G03H 1/0005 345/168
2015/0185841 A1* 7/2015 Levesque ..... G06F 3/016 715/702

OTHER PUBLICATIONS

"Projected Capacitive Technology" published by 3M Touch Systems, on or before Dec. 31, 2013, and printed from URL <http://multimedia.3m.com/mws/media/788463O/tech-brief-projected-capacitive-technology.pdf>, 8 pages.*

* cited by examiner

OPERATION DEVICE AND PLAY MACHINE

CROSS-REFERENCE TO RELATED APPLICATION

This application claims the benefit of foreign priority from Japanese Patent Application No. 2014-120752 filed with the Japan Patent Office on Jun. 11, 2014, the entire contents of which are incorporated herein by reference.

BACKGROUND

Field

The present invention relates to an operation device suitable for a play machine and a play machine provided therewith.

Related Art

Conventionally, there is a play machine called a slot machine. In the slot machine, a plurality of reels in which a plurality of kinds of symbols are displayed rotate, a role is decided depending on the symbols displayed in a window and the combination of the symbols when the reels are stopped, and a prize winning is provided according to the decided role and a bet number. The reels start the rotation when a push button provided in a front surface of the slot machine is pressed or a lever is pulled, and the rotation of the reels is stopped by control of the device.

Not only slot machines manufactured by one play machine manufacturer but also slot machines manufactured by various play machine manufacturers are installed in amusement facilities such as a casino. A player selects a slot machine suitable for the player's taste from slot machines manufactured by various play machine manufacturers, and plays a game using the selected slot machine. Therefore, in amusement facilities, the slot machine popular among players is installed in order to ensure superiority to other competitors. On the other hand, the play machine manufacturers earnestly develop slot machines having strong appeal to the players and performance power in order to meet demands of amusement facilities.

An operation input unit in which the push button or lever used to issue an instruction to start the rotation of the reel, a switch used to input the bet number, and a switch used to select the line are arranged is provided in a conspicuous place on the front face of the slot machine. Additionally, because the operation input unit is directly operated by the player, the operation input unit is considered to be extremely important to be used in the performance and appeal to the player.

For example, in a configuration of a play machine disclosed in Unexamined Japanese Patent Publication No. 2013-165759, a transmission type screen is disposed in an inner surface of a translucent hollow operation element of a button switch, a liquid crystal display projector is disposed on the rear face side of the operation element while directly facing the transmission type screen, and the liquid crystal display projector projects images such as a still image and a moving image onto the transmission type screen.

On the other hand, nowadays, a technique of displaying the image in midair and a gesture controller technique of receiving an input by detecting movement (gesture) of a hand or fingers in midair are actively being developed. For example, there is a technique in which an image of a display such as a liquid crystal display is formed in midair using a special plate such that an observer can see as if a liquid crystal display screen exists there. When the technique of forming the image in midair and the gesture controller technique are combined, an instruction input screen is displayed in midair, and the instruction input can be performed by touching the instruction input screen. Various applications are currently studied in various fields such as an automobile industry, a housing industry, and an amusement industry.

The conventional technique disclosed in Unexamined Japanese Patent Publication No. 2013-165759 is aimed at enhancement of a player's interest by the performance that a 3D image is projected on the inside of the operation element of the operation input unit, but the operation is not associated with the 3D image.

SUMMARY

One or more embodiments of the present invention provides an operation device and a play machine, in which the instruction can be input by a new operation based on the existing operation and a wide variety of interesting performance can be performed.

In accordance with one or more embodiments of the present invention, an operation device installed on a play machine, the operation device includes a push button switch including a push button made of a translucent material, a floating image projector configured to project a floating image into midair above the push button through the push button from a rear face side of the push button, and a gesture detector in which at least a region where the floating image is projected is set to a detection region.

In addition to the conventional operation to press the push button using the push button switch, the floating image can be projected with the floating image projector, and the gesture that is motion of a hand or fingers of the player can be detected with the gesture detector.

Therefore, in the play machine, based on the conventional operation to press the push button, the instruction input by the new operation and a wide variety of interesting performance in which the push button, the floating image, and the instruction input by the gesture are fused can be performed by a combination of the floating image projected above the push button and the gesture detection in which the projection region of the floating image is set to the detection range.

In the operation device, the push button may include a light guide plate, and the push button switch may include a light source configured to supply light to the light guide plate.

The light guide plate included in the push button emits the light, and therefore the push button emits the light. Accordingly, an emission pattern formed in the light guide plate is set to a mode in which a logo is displayed or a mode in which a whole surface emission is performed, which allows the wide variety of interesting performance to be further performed.

In accordance with one or more embodiments of the present invention, a play machine comprises an operation device according to one or more embodiments of the present invention, and a controller that controls the push button switch, the floating image projector, and the gesture detector.

A play machine according to one or more embodiments of the present invention, which includes an operation device according to one or more embodiments of the present invention, may include one or more of the above-mentioned effects.

In the play machine, the controller may perform control while correlating the floating image of the floating image projector, a gesture detected by the gesture detector, and a push button pressing operation detected by the push button switch with one another.

Therefore, in the play machine, the instruction input by the new operation and the wide variety of interesting performance in which the push button, the floating image, and the instruction input by the gesture are fused can be implemented using the operation device according to one or more embodiments of the present invention.

DETAILED DESCRIPTION

Hereinafter, embodiments of the present invention will be described with reference to the drawings. However, the present invention is not limited to the following embodiments, and various changes can be made without departing from the scope of the present invention. In embodiments of the invention, numerous specific details are set forth in order to provide a more thorough understanding of the invention. However, it will be apparent to one of ordinary skill in the art that the invention may be practiced without these specific details. In other instances, well-known features have not been described in detail to avoid obscuring the invention.

The operation device according to one or more embodiments of the present invention can be used as operation devices for various play machines, and an example in which the operation device according to one or more embodiments of the present invention is installed on a slot machine that is of the play machine is described.

Figure 1:
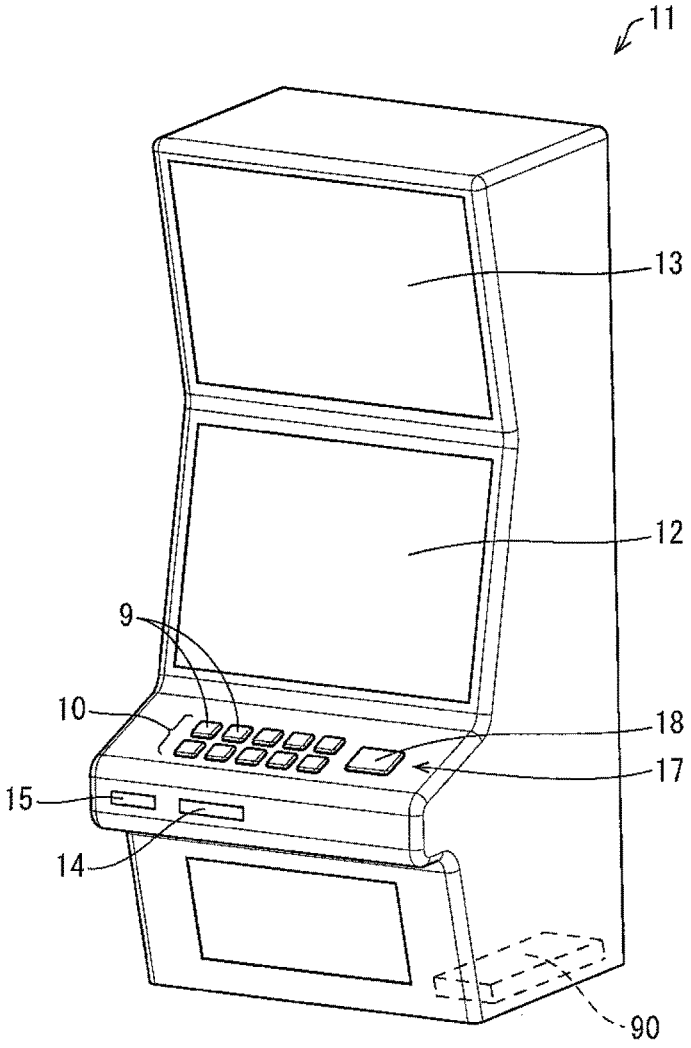
FIG. 1 is a schematic perspective view illustrating a slot machine equipped with an operation device according to one or more embodiments of the present invention.

FIG. 1 is a schematic perspective view illustrating a slot machine 11 equipped with an operation device 17 according to one or more embodiments of the present invention. As illustrated in FIG. 1, in the slot machine 11, a reel unit 12 is provided in a central portion of a front facing a player (operator).

The reel unit 12 includes a plurality of reels (not illustrated) in which a plurality of kinds of symbols are displayed. The plurality of reels start rotation when the player operates a button 18, and the rotation is automatically stopped by control of the device. In the slot machine 11, a role is decided by the kind of the matched symbols and the combination of the symbols on a selected line displayed in a window (not illustrated) of the reel unit 12 when the reels are stopped, and a prize winning is provided to the player according to the decided role and a bet number. Examples of the configuration of the reel unit 12 include a configuration in which the reels are actually provided and a configuration in which images corresponding to the reels are displayed on a display screen such as a liquid crystal screen.

A display screen 13 on which various pieces of information are displayed for the player is provided above the reel unit 12. A button operation unit 10 in which a plurality of buttons 9 are arranged, the operation device 17 that includes a button 18 larger than the button 9, a bill insertion port 14, and a ticket dispensing port 15 are provided in a portion projecting forward below the reel unit 12.

The button operation unit 10 is mainly used to select the line and to designate the bet number. On the other hand, the operation device 17 is used to give an instruction to start the rotation of the reel, and in addition, used in the selection of the line, the designation of the bet number, and performance of a mini-game using an operation to press the button 18, a floating image display in midair above the button 18, and an instruction input by a gesture (to be described in detail later). The button 18 has a rectangular shape extending horizontally, and is formed relatively large in consideration of operability during the instruction input by the gesture using the floating image formed through the button 18.

Figure 2:
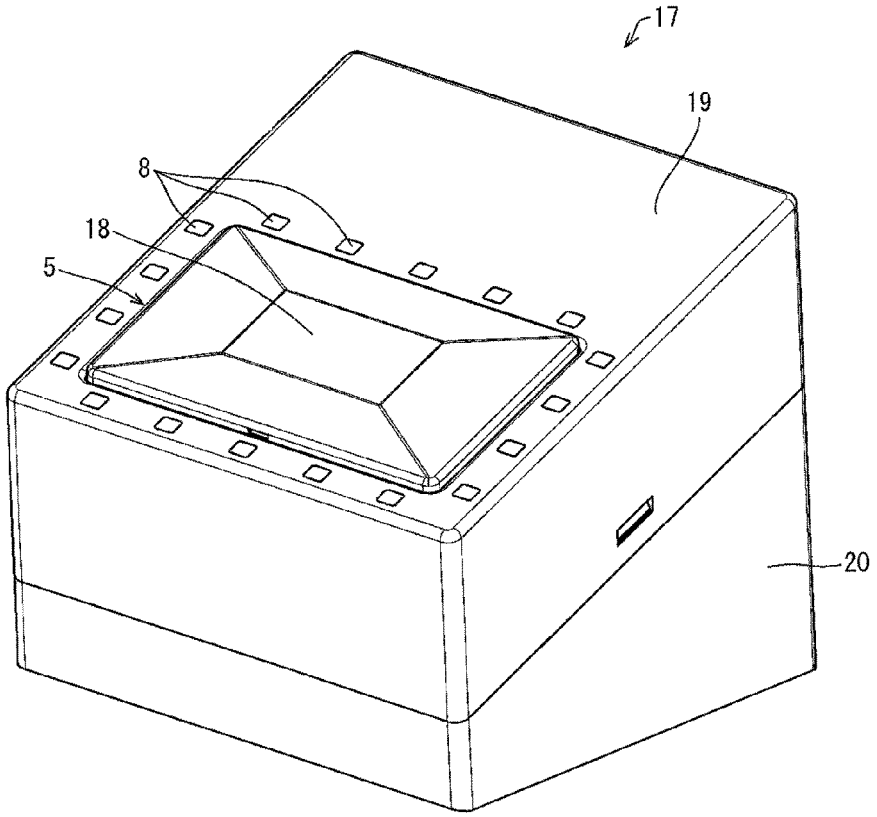
FIG. 2 is a perspective view illustrating an appearance of the operation device.
Figure 3:
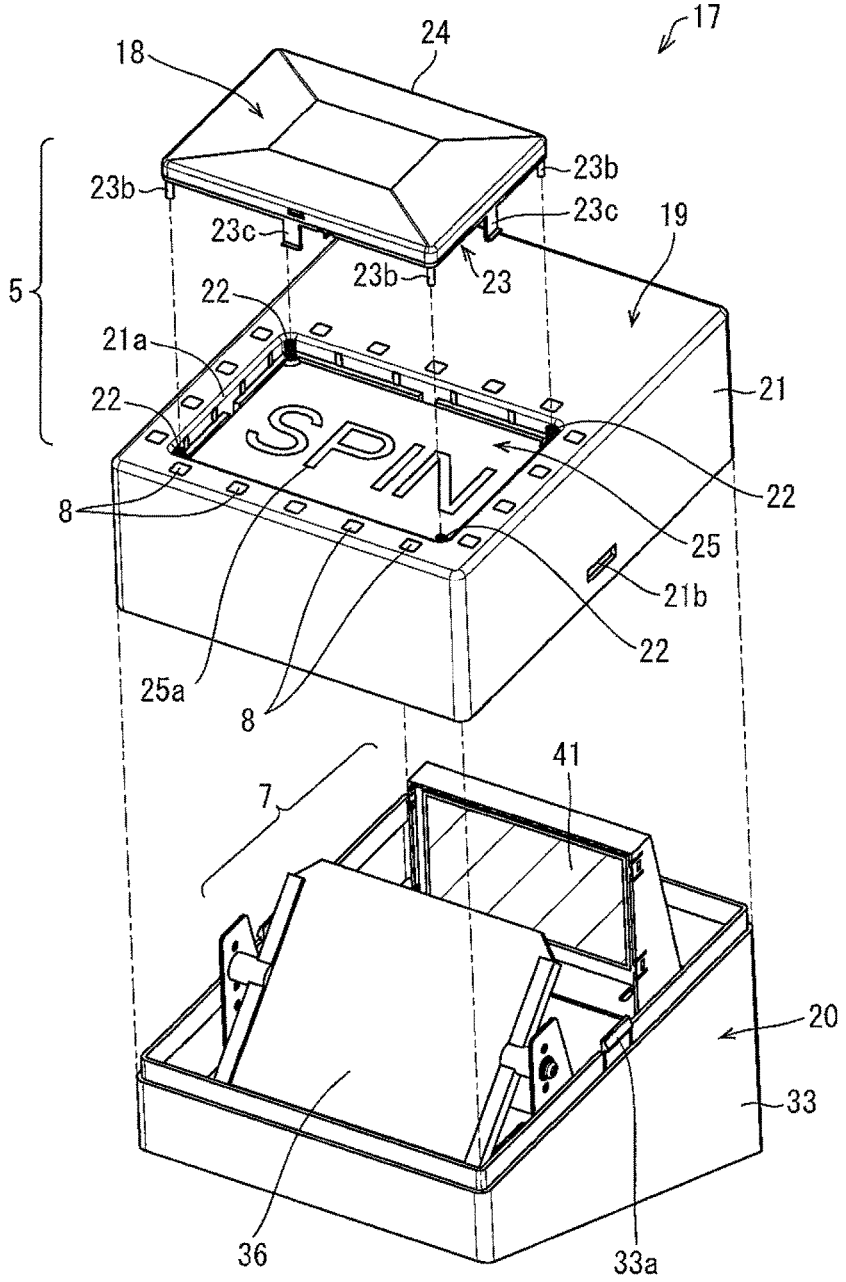
FIG. 3 is an exploded perspective view of the operation device.

FIG. 2 is a perspective view illustrating an appearance of the operation device 17, and FIG. 3 is an exploded perspective view of the operation device 17. As illustrated in FIG. 2, in the operation device 17, a top surface including the button 18 has a cubic appearance in which the level of a front side is inclined lower than the level of a back face side. The operation device 17 includes the button 18, an upper frame 19, and a lower frame 20.

As illustrated in FIG. 3, the upper frame 19 includes an upper case 21 that has a rectangular shape when viewed in any one of a longitudinal direction, a crosswise direction, and a vertical direction (a direction along a pressing direction) of the button 18. A button opening 21*a* is formed in the top surface of the upper case 21, and the button 18 is provided in the button opening 21*a*. A light guide plate 25 in which a logo emission pattern 25*a* of, for example, "SPIN" is formed is disposed in the upper case 21 while facing a rear face side of the button 18. A plurality of light emitting units 8 are disposed around the button 18 in the upper case 21. The button 18, springs 22 (see FIG. 5), the light guide plate 25, a lens retaining unit 26 (see FIG. 5), and an LED board 27 (see FIG. 5) constitute a push button switch 5 (see FIG. 3). The springs 22, the light guide plate 25, the lens retaining unit 26, and the LED board 27 are provided in the upper case 21, and described later.

On the other hand, the lower frame 20 includes a lower case 33. The lower case 33 has the rectangular shape when viewed from the crosswise and vertical directions of the button 18, and the lower case 33 has a trapezoidal shape in which the front side is inclined lower when viewed from the longitudinal direction of the button 18. A floating image projector 7 that projects the floating image into midair above the button 18 is provided in the lower case 33. The floating image projector 7 includes an LCD (Liquid Crystal Device)

41 and a special plate 36, an image displayed on the LCD 41 is formed in midair above the button 18 through the plate 36 to play back a virtual image similar to the image in the LCD 41.

A fitting hook 33*a* formed in the lower case 33 is fitted in a fitting hole 21*b* formed in the upper case 21, thereby integrating the upper frame 19 and the lower frame 20.

Figure 4:
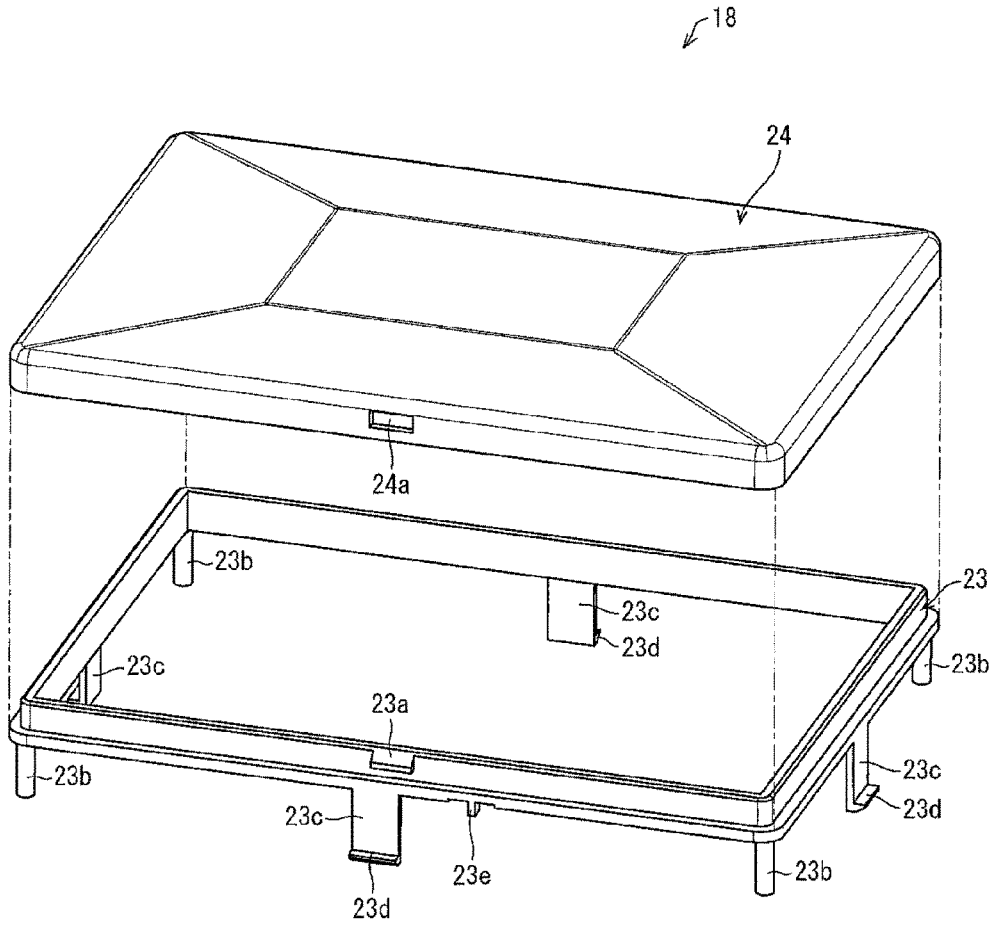
FIG. 4 is an exploded perspective view illustrating a button of the operation device.

FIG. 4 is an exploded perspective view of the button 18. As illustrated in FIG. 4, the button 18 includes a button cover 24 and a button case 23 that supports the button cover 24. The button cover 24 is made of a translucent material so as to transmit projection light from the floating image projector 7. The button case 23 is a frame-shape member, and supports the button cover 24 on an outer peripheral side thereof. A fitting hook 23*a* formed in the button case 23 is fitted in a fitting hole 24*a* formed in the button cover 24, thereby integrating the button cover 24 and the button case 23.

Shafts 23*b*, which enable the button 18 to move vertically along the pressing direction, project at four corners on the rear face side (an opposite side to the side of the button cover 24) of the button case 23. A guide 23*c* projects at an intermediate position of each of four sides constituting the frame on the rear face side of the button case 23, in order to stabilize vertical movement of the button 18 along the pressing direction. A latch hook 23*d* is formed at a leading end of the guide 23*c*, and the latch hook 23*d* abuts on a guide groove 6*b* (see FIG. 5, to be described later) to prevent a drop of the button 18. A detection projection 23*e* is provided in the side located on the front side on the rear face side of the button case 23 in order that a sensor 2 (see FIG. 5, to be described later) detects the operation to press the button 18.

Figure 5:
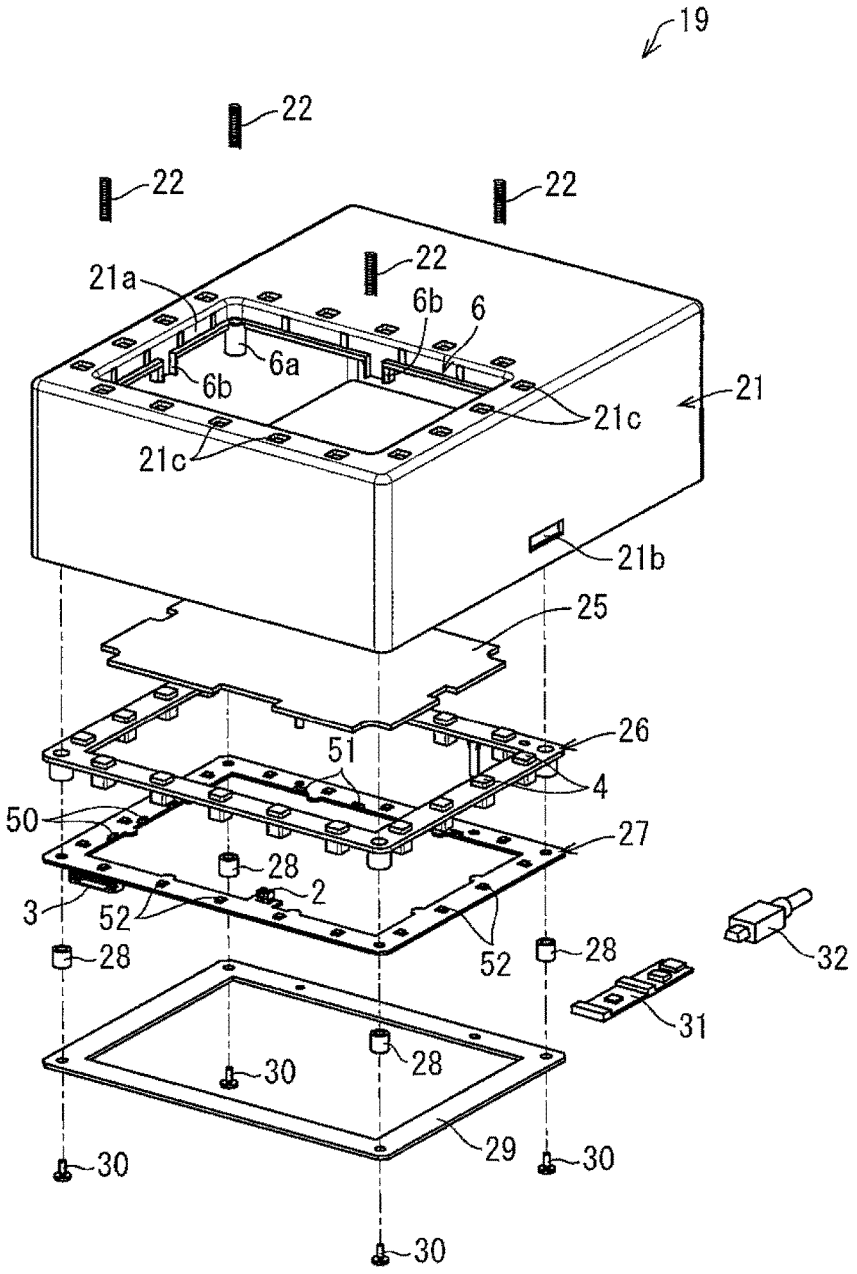
FIG. 5 is an exploded perspective view illustrating an upper frame of the operation device.

FIG. 5 is an exploded perspective view of the upper frame 19. The upper frame 19 includes the upper case 21, the springs 22, the light guide plate 25, the lens retaining unit 26, the LED board 27, a spacer 28, a 3D gesture controller board 29, a processor 31, and a USB 32. The springs 22, the light guide plate 25, the lens retaining unit 26, the LED board 27, the spacer 28, the 3D gesture controller board 29, the processor 31, and the USB 32 are provided in the upper case 21.

The upper case 21 includes a plurality of small LED openings 21*c* constituting a light emitting unit 8 around the button opening 21*a*, and an attaching unit 6 is provided inside the button opening 21*a* in order to attach the button 18 to the button opening 21*a*. Shaft hole units 6*a* in which the shafts 23*b* provided in the button case 23 are slidably inserted in the vertical direction (axial direction) are formed at four corners of the button opening 21*a* in the attaching unit 6. The leading end sides of the button 18 are inserted in the shaft hole units 6*a* while the shafts 23*b* are inserted in the springs 22. The guide grooves 6*b* are also formed in the attaching unit 6 in order to stabilize the vertical movement of the guides 23*c*.

Each of the lens retaining unit 26, the LED board 27, and the 3D gesture controller board 29 is a frame-shape member having an opening of a size equal to that of the button opening 21*a* formed in the upper case 21.

The LED board 27 is a circuit board in which a plurality of LEDs (Light Emitting Diodes) are mounted on the top surface, and the top surface supports the outer peripheral portion of the light guide plate 25. The logo emission pattern 25*a* constituting characters of, for example, "SPIN" and a whole surface emission pattern 25*b* (see FIG. 9A) used to perform whole surface emission are formed in the light guide plate 25. In the LED board 27, a plurality of logo emission LEDs 51 that emit the light of the logo emission pattern 25*a* are included in the side on the back face side, and a plurality of whole surface emission LEDs 50 that emit the light of the whole surface emission pattern 25*b* are included in the side on a lateral surface side. The light beams emitted from the LEDs 50 and 51 are supplied to the light guide plate 25 through an end face of the outer peripheral portion. The LED board 27 also includes a plurality of decorative LEDs 52 constituting the light emitting unit 8. According to one or more embodiments of the present invention, the plurality of LEDs 50, 51, and 52 can produce full-color light. The lighting of each of the plurality of LEDs 50, 51, and 52 is controlled according to an externally-input control signal, and a connector 3 to which external wiring is connected is mounted on the rear face of the LED board 27.

A sensor 2 is mounted on the top surface of the LED board 27. The sensor 2 detects the operation to press the button 18 by detecting the detection projection 23*e* formed in the button 18. A detection result of the sensor 2 is output through the external wiring connected to the connector 3. The external wiring is connected to a controller 90 (see FIG. 1, to be described later) of the slot machine 11.

The lens retaining unit 26 includes a plurality of lenses 4 at the positions corresponding to the plurality of decorative LEDs 52 mounted on the LED board 27. Each lens 4 is provided such that the top surface of the lens 4 is seen through the LED opening 21*c* of the upper case 21. The light emitted from the decorative LEDs 52 is released by the lens 4 through the LED opening 21*c*, thereby forming the light emitting unit 8.

The 3D gesture controller board (gesture detector) 29 is a user interface that detects the hand or finger movement (gesture) performed in a predetermined space above the button 18. The processor 31 is connected to the 3D gesture controller board 29, and processes information received by the 3D gesture controller board 29. The USB 32 is connected to the processor 31, and enables the signal to be input to and output from the processor 31.

The lens retaining unit 26, the LED board 27 that supports the light guide plate 25, and the 3D gesture controller board 29 are stacked in this order, and four corners of each of the lens retaining unit 26, the LED board 27, and the 3D gesture controller board 29 are fixed to the upper case 21 by screws 30 such that the button opening 21*a* is closed by the light guide plate 25. The spacer 28 is interposed between the LED board 27 and the 3D gesture controller board 29.

Figure 6:
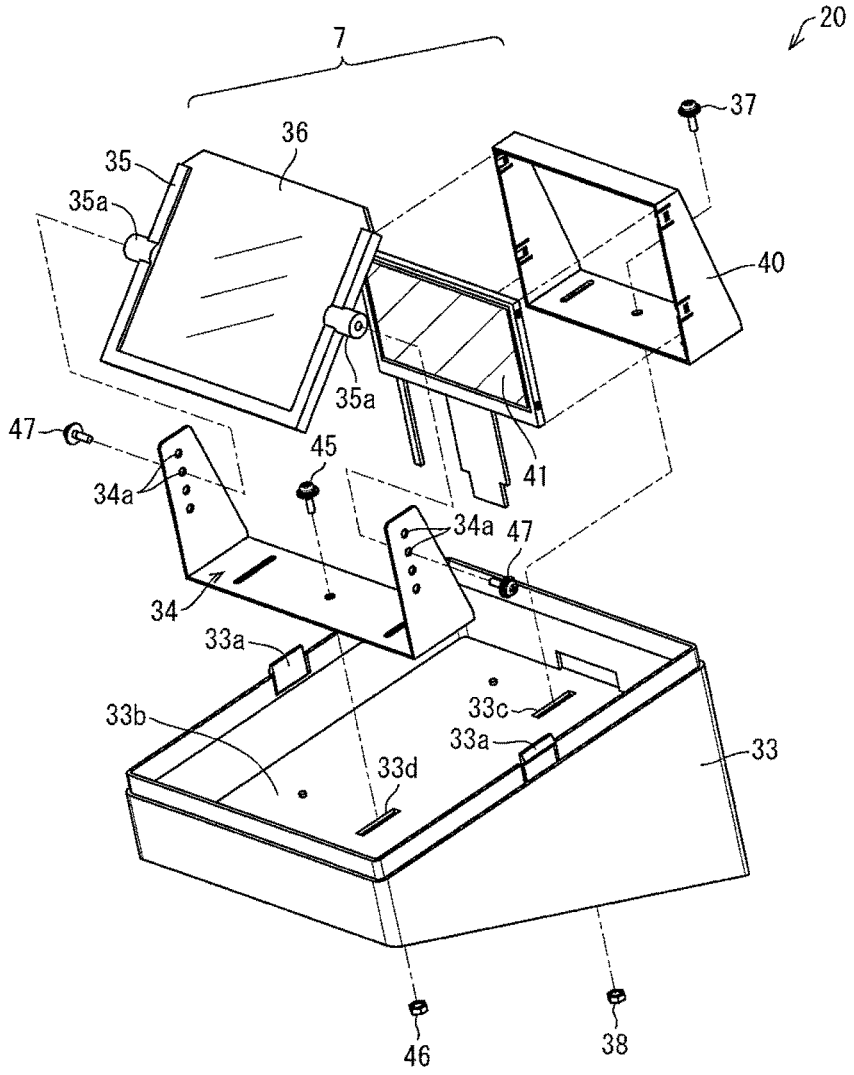
FIG. 6 is an exploded perspective view illustrating a lower frame of the operation device.

FIG. 6 is an exploded perspective view of the lower frame 20. The lower frame 20 includes the lower case 33, a bracket 34, a holder 35, the plate 36, an LCD holder 40, and an LCD 41. The bracket 34, the holder 35, the plate 36, the LCD holder 40, and the LCD 41 are provided in the lower case 33. As described above, the plate 36 and the LCD 41 constitute the floating image projector 7.

An inner bottom 33*b* of the lower case 33 has an inclination in which the back face side is high while the front side is low, the LCD 41 is provided on the back face side, and the plate 36 is provided on the front side. The LCD 41 is held by the LCD holder 40, and the LCD holder 40 is substantially perpendicularly attached to the inner bottom 33*b* by a screw 37 and a nut 38. A screw hole 33*c* in which the screw 37 is inserted is made long in the inner bottom 33*b* so as to be able to adjust a distance to the plate 36.

On the other hand, the plate 36 is held by the holder 35, and the holder 35 is attached to the bracket 34. The bracket 34 is substantially perpendicularly attached to the inner bottom 33*b* by a screw 45 and a nut 46, the holder 35 is attached to the bracket 34 using a pair of screws 47 such that the plate 36 to be held has a predetermined angle (for example, 45 degrees) with respect to a display surface of the LCD 41. A plurality of screw holes 34*a* are made in a height direction of the bracket 34 such that the level of the plate 36 can be adjusted. A screw hole 33*d* in which the screw 45 is inserted is also made long in the inner bottom 33*b* so as to be able to adjust the distance to the LCD 41.

The plate 36 forms the image displayed on the LCD 41 in midair above the button 18 through the button 18 using a technique of an orthogonal dihedral reflector.

Figure 7B:
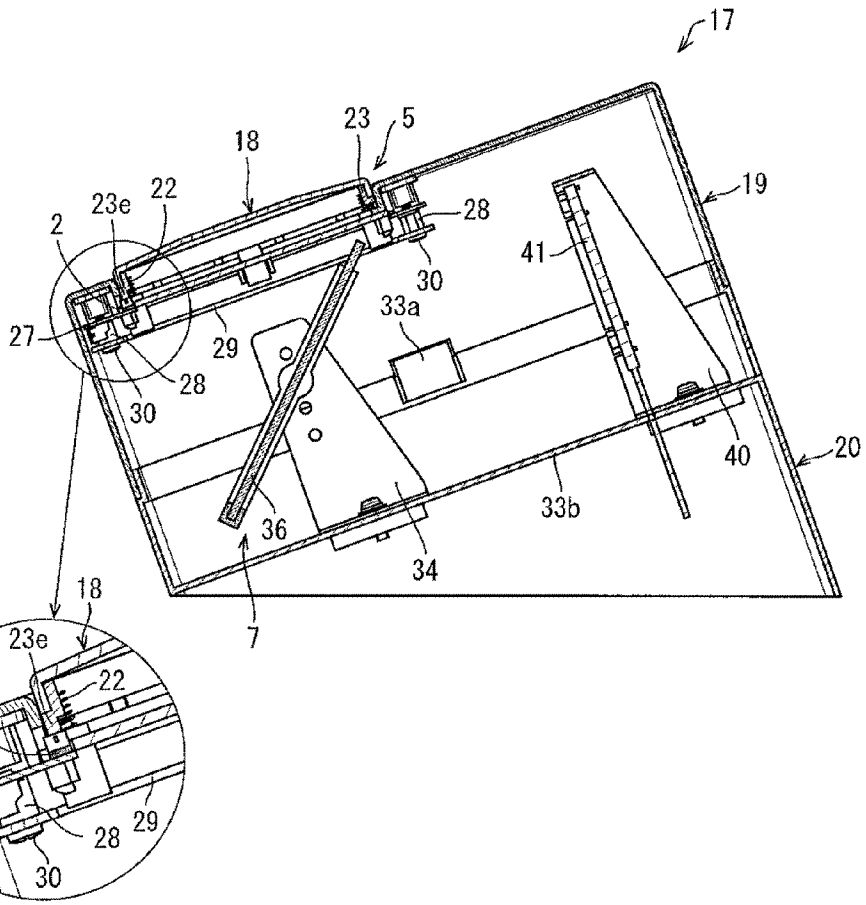
FIGS. 7A and 7B are views illustrating a button pressing operation in the operation device.
Figure 7A:
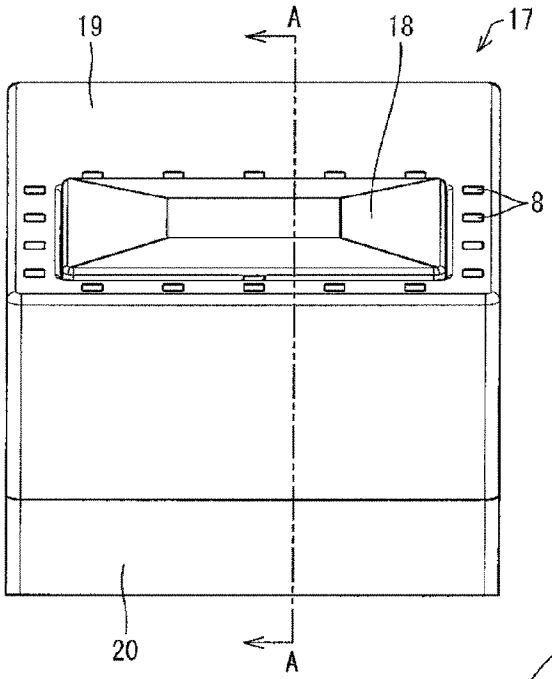

FIGS. 7A and 7B are views illustrating an operation to press the button 18 in the operation device 17, FIG. 7A is a front view of the operation device 17, and FIG. 7B is a sectional view taken on line A-A in FIG. 7A. When the player of the slot machine 11 presses the button 18 during the start of the game, the performance, or the selection, the button 18 moves downward against the spring 22 as illustrated in FIG. 7B. When the button 18 moves downward, the detection projection 23*e* provided in the rear face of the button case 23 enters the detection region of the sensor 2 mounted on the LED board 27, and the sensor 2 detects the detection projection 23*e*, thereby detecting the operation to press the button 18. When the pressing against the button 18 is released, the button 18 is uplifted by a biasing force of the spring 22, and returns to an original state.

Figure 8B:
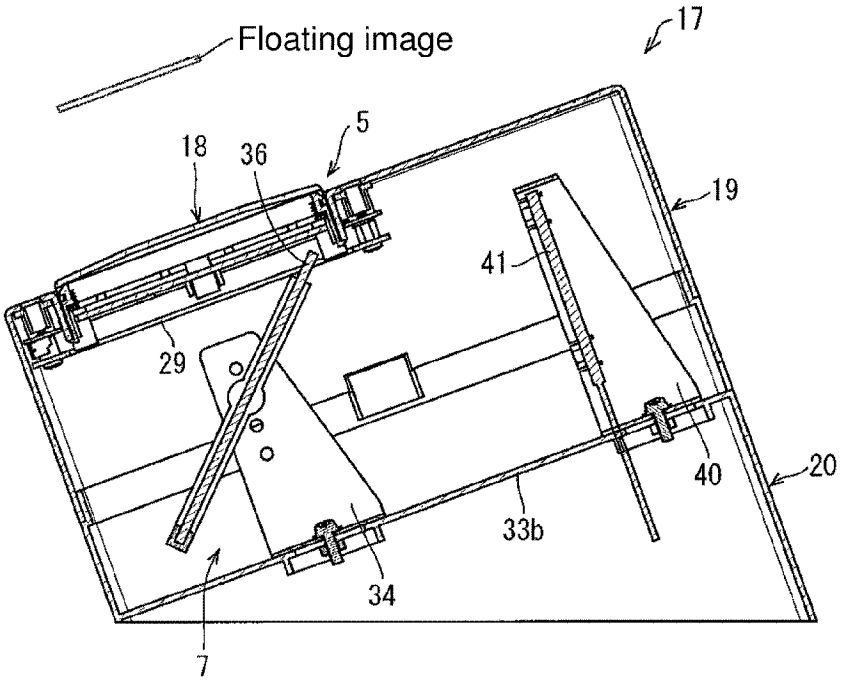
FIGS. 8A and 8B are views illustrating a floating image projector in the operation device.
Figure 8A:
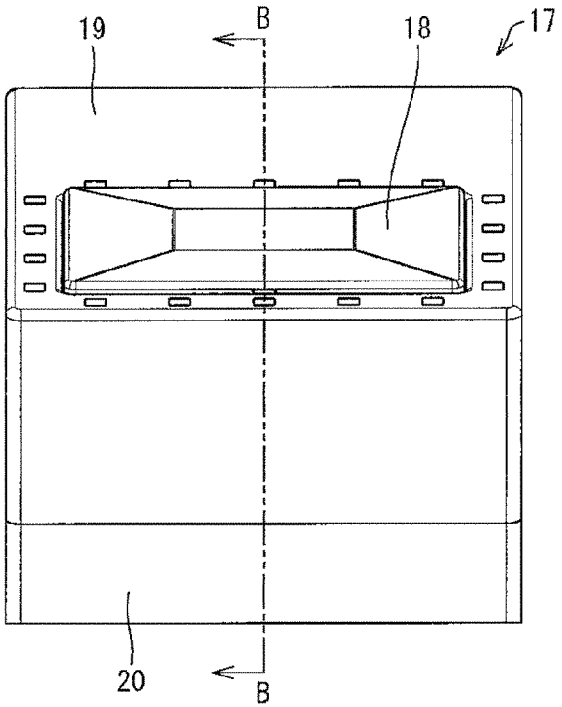

FIGS. 8A and 8B are views illustrating the floating image projector 7 in the operation device 17, FIG. 8A is a front view of the operation device 17, and FIG. 8B is a sectional view taken on line B-B in FIG. 8A. As illustrated in FIG. 8B, the image displayed on the LCD 41 is formed as a floating image in midair above the button 18 through the plate 36.

Figure 9C:
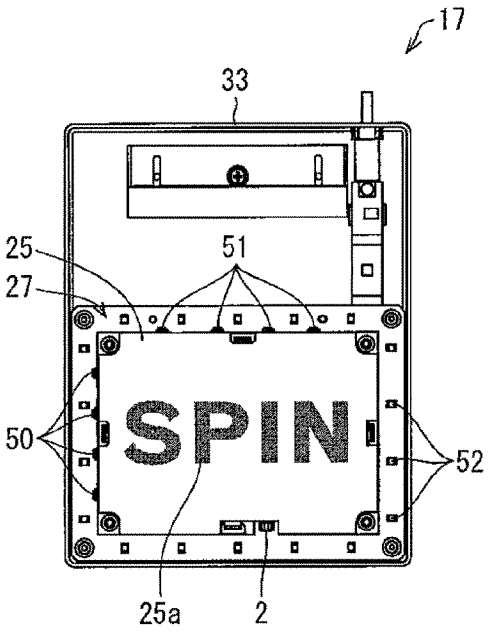
FIGS. 9A to 9C are views illustrating display generated by emission of a light guide plate in the operation device.
Figure 9B:
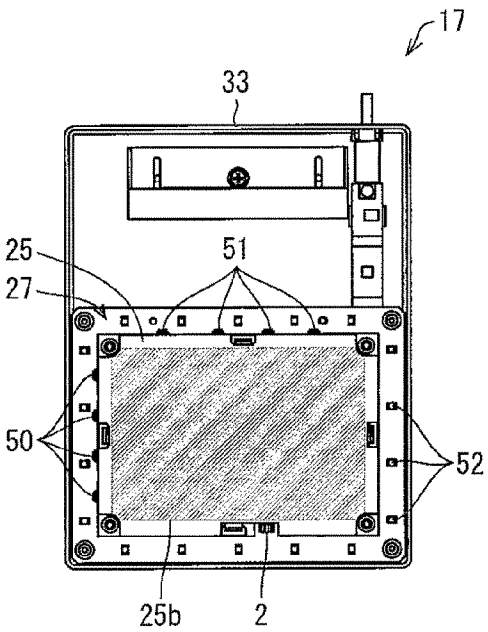
Figure 9A:
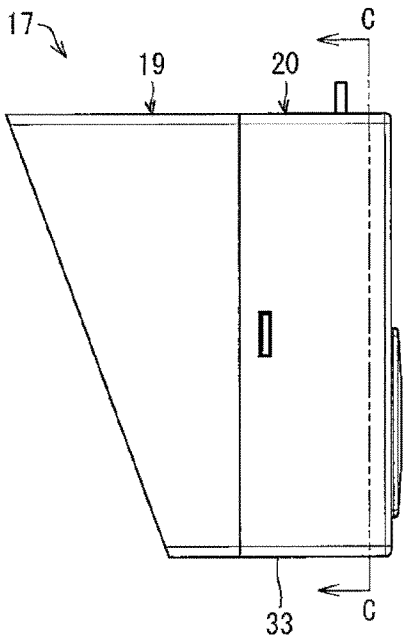

FIGS. 9A to 9C are views illustrating the display by the emission of the light guide plate in the operation device 17, FIG. 9A is a side view of the operation device 17, and FIGS. 9B and 9C are sectional views taken on line C-C in FIG. 9A. As illustrated in FIG. 9B, when the whole surface emission LEDs 50 are lit while the logo emission LEDs 51 are turned off, the whole surface emission pattern 25*b* of the light guide plate 25 can emit the light to generate the whole surface emission in the button 18. As illustrated in FIG. 9C, when the logo emission LEDs 51 are lit while the whole surface emission LEDs 50 are turned off, the logo emission pattern 25*a* of the light guide plate 25 can be emitted to display the characters "SPIN" in the button 18.

Figure 10B:
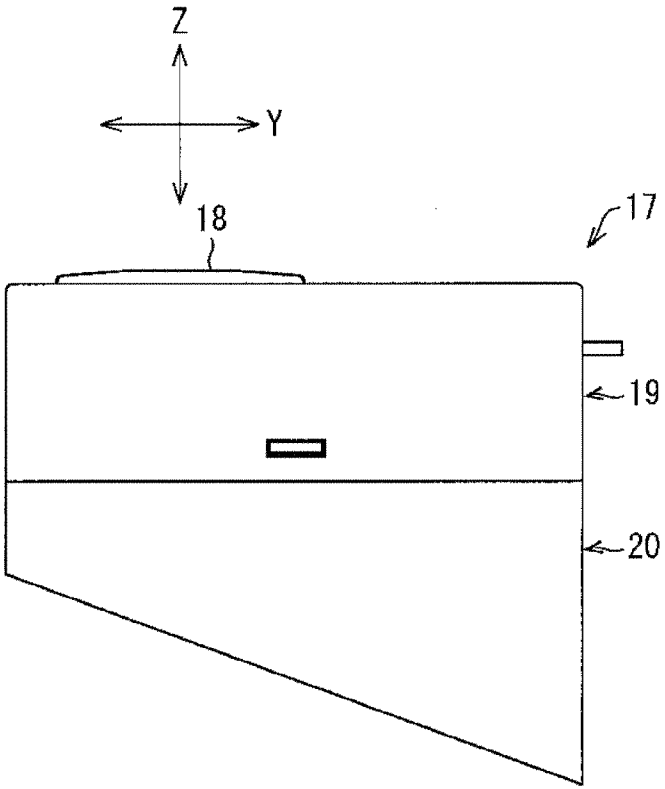
FIGS. 10A and 10B are views illustrating detection action of a 3D gesture controller board in the operation device.
Figure 10A:
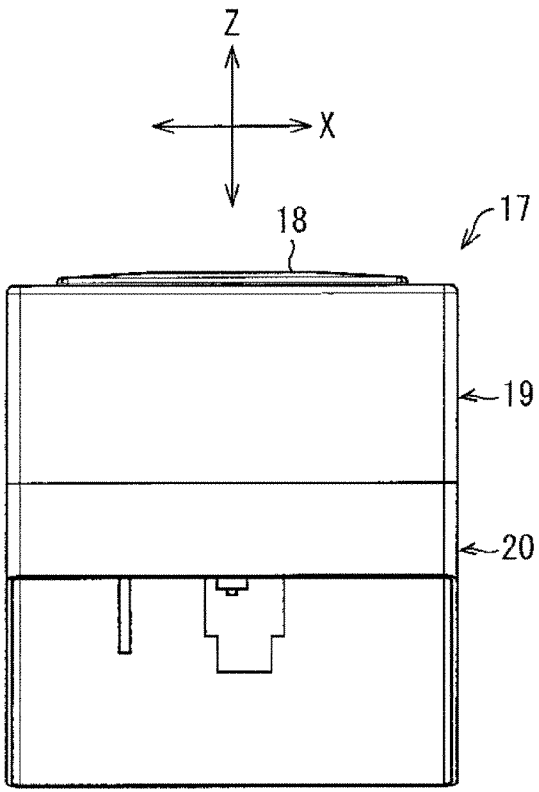

FIGS. 10A and 10B are views illustrating detection action of the 3D gesture controller board 29 in the operation device 17, FIG. 10A is a front view illustrating the operation device 17 while the inclined top surface is leveled off, and FIG. 10B is a side view illustrating the operation device 17 while the inclined top surface is leveled off. As illustrated in FIGS. 10A and 10B, the 3D gesture controller board 29 detects the player action (mainly a finger or a palm) in a detectable region in the midair above the button 18, and the processor 31 outputs an action direction (X, Y, and Z directions), an action speed, and positional information onto the side of the slot machine 11.

In the slot machine 11 equipped with the operation device 17, based on the conventional operation to press the button 18, the instruction input by the new operation and a wide variety of interesting performance in which the button 18, the floating image, and the instruction input by the gesture are fused can be performed by the combination of the floating image projected above the button 18 and the gesture detection in which the projection region of the floating image is set to the detection range.

The performance effect can be enhanced to perform the wide variety of interesting performance when the display screen 13 is controlled in conjunction with the operation to press the button 18, the floating image, and the detection of the gesture of the player.

Because the button 18 includes the light guide plate 25 and the light emitting unit 8, the performance effect can further be enhanced to perform the wide variety of interesting performance when the whole surface emission LEDs 50, logo emission LEDs 51, and decorative LEDs 52 of the LED board 27 are controlled in conjunction with the operation to press the button 18, the floating image, the detection of the gesture of the player, the reel unit 12, and the display screen 13.

The performance in the slot machine 11 is performed by the controller 90 mounted on the slot machine 11 (see FIG. 1). The controller 90 includes a CPU and a storage, and controls each unit of the slot machine 11, namely, the reel unit 12, the display screen 13, the button operation unit 10, the operation device 17, and the like. Various performance contents are stored in the storage, and the CPU reads the performance content from the storage, and drives each unit of the slot machine 11 according to the performance content to perform the performance. Alternatively, a control circuit that performs only control associated with the operation device 17 may be mounted on the operation device 17.

Figure 11:
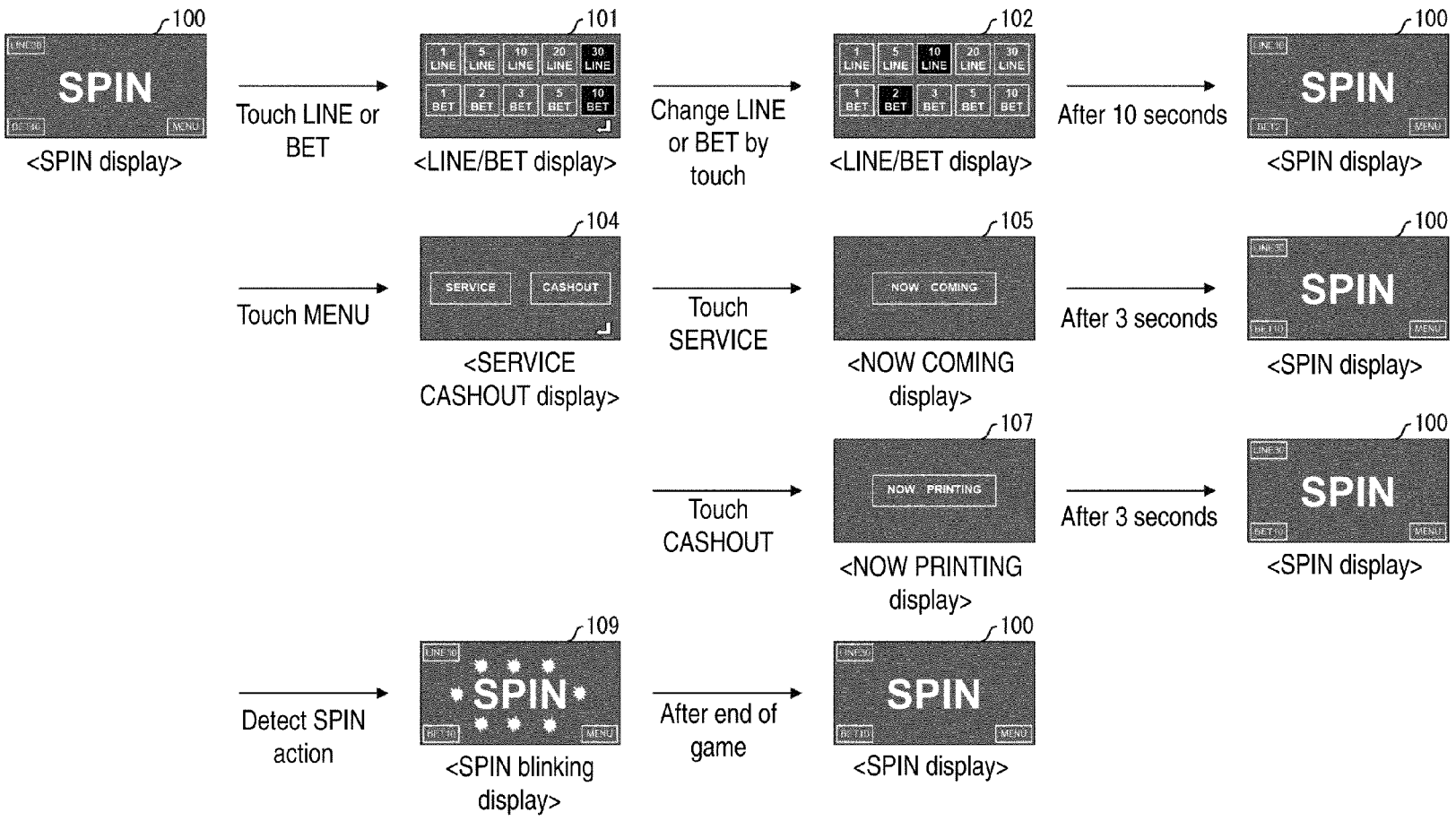
FIG. 11 is a view illustrating an example of operation input using a floating image in the operation device.

FIG. 11 is a view illustrating an example of operation input using the floating image in the operation device 17. When the LCD 41 of the floating image projector 7 is turned on while the whole surface emission LEDs 50 and logo emission LEDs 51 of the LED board 27 are turned off, the floating image rises above the button 18 in the operation device 17. A SPIN display 100 that is of a basic floating image of an operation mode is illustrated in the example of FIG. 11. "LINE", "BET", and "MENU" buttons are also illustrated in the SPIN display 100 together with the characters "SPIN" largely displayed in the center.

In the SPIN display 100, when the player touches the "LINE" or "BET" button, and the 3D gesture controller board 29 detects the touch to the "LINE" or "BET" button, the controller 90 switches the floating image to a LINE/BET display 101. The buttons used to select the line number and the buttons used to select the bet number are displayed in the LINE/BET display 101, and the controller 90 changes a color of the button touched by the player (LINE/BET display 102). For example, when 10 seconds elapse after the selection, the controller 90 returns the LINE/BET display 101 to the SPIN display 100.

On the other hand, in the SPIN display 100, when the player touches the "MENU" button, and the 3D gesture controller board 29 detects the touch to the "MENU" button, the controller 90 switches the floating image to a SERVICE/CASHOUT display 104. "SERVICE" and "CASHOUT" buttons are displayed in the SERVICE/CASHOUT display 104.

In the SERVICE/CASHOUT display 104, when the player touches the "SERVICE" button, and the 3D gesture controller board 29 detects the touch to the "SERVICE" button, the controller 90 informs a staff of the amusement facility where the slot machine 11 is installed that the player touches the "SERVICE" button, and switches the floating image to a NOW COMING display 105. For example, when 3 seconds elapse, the controller 90 returns the NOW COMING display 105 to the SPIN display 100.

On the other hand, in the SERVICE/CASHOUT display 104, when the player touches a "CASHOUT" button, and the 3D gesture controller board 29 detects the touch to the "CASHOUT" button, the controller 90 discharges a ticket on which a money amount corresponding to a game result is described from the ticket dispensing port 15, and switches the floating image to a NOW PRINTING display 107. For example, when 3 seconds elapse, the controller 90 returns the NOW PRINTING display 107 to the SPIN display 100.

In the SPIN display 100, when the player moves the player's hand or finger so as to press the SPIN display 100 (SPIN action), and the 3D gesture controller board 29 detects the SPIN action, the controller 90 switches the floating image to a SPIN blinking display 109. When the game is ended, the controller 90 returns the SPIN blinking display 109 to the SPIN display 100. When the button 18 is pressed while the SPIN display 100 is displayed as the floating image, the controller 90 also switches the floating image to the SPIN blinking display 109. Thus, when the floating image is used as the operation screen to which the operation necessary for the play is input, the player can perform the operation in midair.

Figure 12:
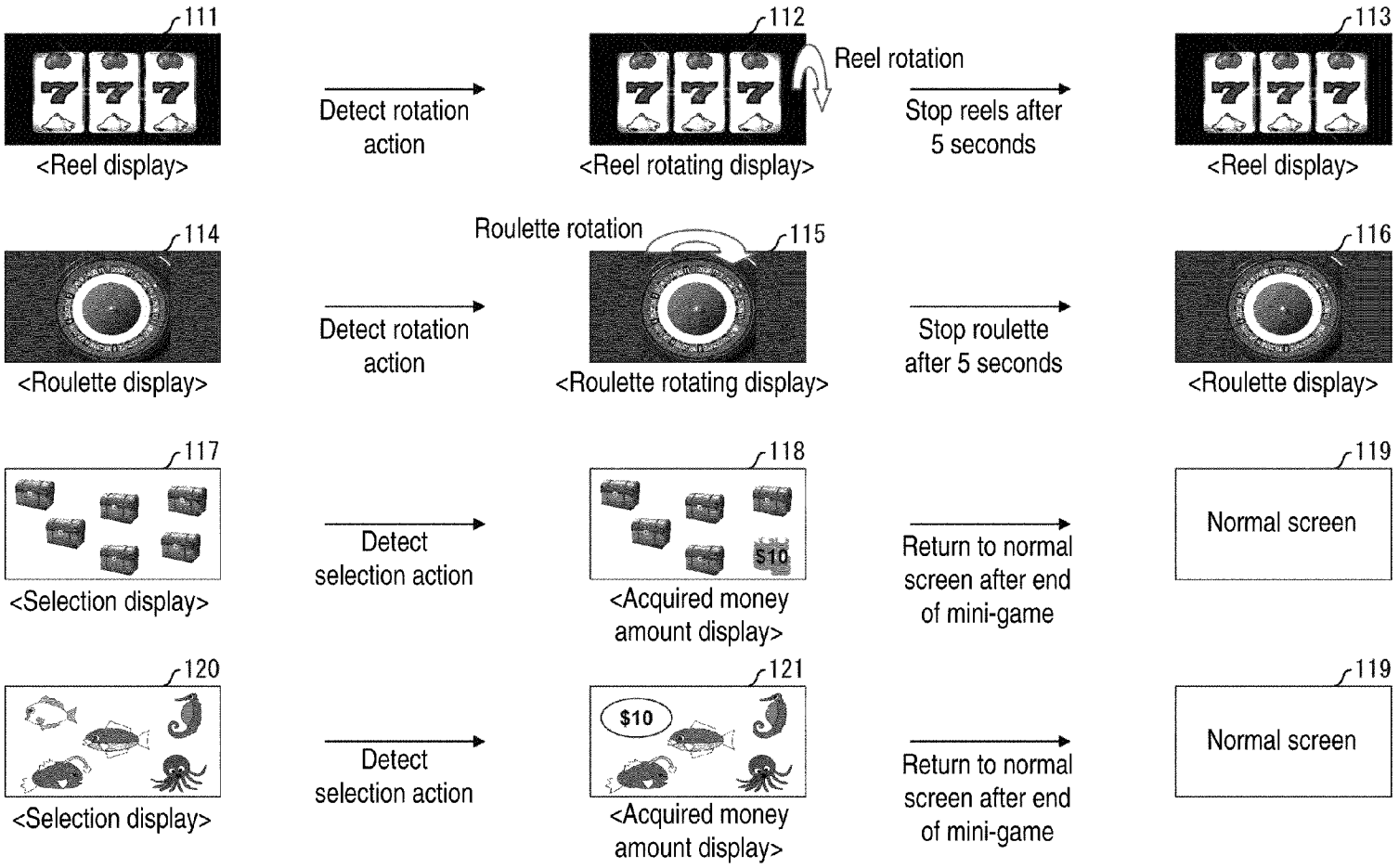
FIG. 12 is a view illustrating an example of performance using the floating image in the operation device.

FIG. 12 is a view illustrating an example of the performance using the floating image in the operation device 17. FIG. 12 illustrates an example of a mini-game in the performance mode. The image of the stopped reels is displayed on a reel display 111 that is of the floating image. In the reel display 111, when the player moves player's hand so as to rotate the reels (rotation action), and the 3D gesture controller board 29 detects the rotation action, the controller 90 displays the floating image of a reel rotating display 112 in which the reels are rotating. When 5 seconds elapse, the controller 90 displays a reel display 113 in which the reels are stopped.

The image of a stopped roulette is displayed on a roulette display 114 that is of the floating image. In the roulette display 114, when the player moves player's hand so as to rotate the roulette (rotation action), and the 3D gesture controller board 29 detects the rotation action, the controller 90 displays the floating image of a roulette rotating display 115 in which the roulette is rotating. When 5 seconds elapse, the controller 90 displays a roulette display 116 in which the roulette is stopped.

The images of a plurality of treasure boxes or fishes are displayed on selection displays 117 and 120 that are of the floating images. In the selection display 117 or 120, when the player touches one of images of the treasure boxes and fishes (selection action), and the 3D gesture controller board 29 detects the selection action, the controller 90 displays the floating image of acquired money amount display 118 or 121 indicating the money amount according to the selected treasure box or fish. When the mini-game is ended, the controller 90 returns the floating image to a normal screen 119.

Thus, the selection in the mini-game and various kinds of performance such as the roulette, the reel, and the Poker game, which have been performed on the display screen 13 on the chassis side, can be performed in midair to obtain the high performance effect when the floating image is used as the performance screen.

Figure 13:
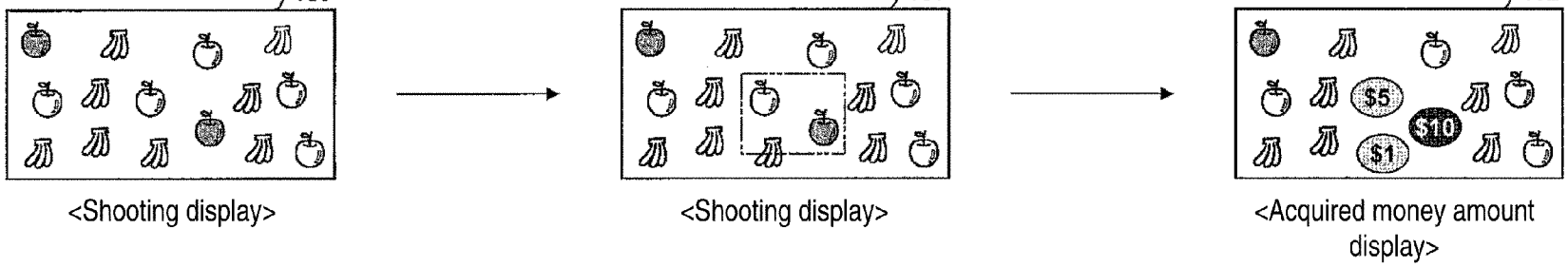
FIG. 13 is a view illustrating another example of the performance using the floating image in the operation device.

FIG. 13 is a view illustrating another example of the performance using the floating image in the operation device 17. FIG. 13 also illustrates an example of the mini-game in the performance mode. A plurality of targets (such as apples and bananas) are displayed on a shooting display 130 that is of the floating image. In the shooting display 130, when the player continuously strikes the button 18, the push button switch 5 detects the continuous strike by the player, and the 3D gesture controller board 29 detects magnitude of the continuous strike action. The controller 90 fixes the size of a shootable region (a region surrounded by an alternate long and two short dashes line in a shooting display 131) according to the number of pressing times within a predetermined time and the magnitude of the continuous strike action. When the player sequentially touches the targets in the shootable region (shooting action), and the 3D gesture controller board 29 detects the shooting action, the controller 90 displays the floating image of an acquired money amount display 132 on which the hit target is changed to the money amount display corresponding to the target. The shooting display 130 (131) and the acquired money amount display 132 may be not only displayed as the floating image but also displayed on the display screen 13 on the chassis side.

Thus, the new operation and performance, which are neither obtained by the conventional button pressing operation nor obtained only by the instruction input by the gesture, can be implemented by combining the operation to press the button 18 with the player's hand or finger movement (gesture) with respect to the floating image.

In the instruction input by the gesture with respect to the floating image, the floating image that changes in conjunction with the movement of the player allows the player to check whether the operation of the player is valid. Accordingly, timing is hardly predicted, but a response is not obtained because the player's hand does not touch the button or the operation panel. On the other hand, the secure response that is not obtained by the instruction input by the gesture can be provided to the player in the operation to press the button 18. Additionally, because the time the player performs the operation is substantially matched with the time the operation of the player is detected on the side of the slot machine 11, the performance can be implemented in the mini-game in which the operation time is important.

By the combination of the operation to press the button 18 and the instruction input by the gesture, a disadvantage of the instruction input by the gesture can be covered to further implement the interesting performance.

Within the range where the player need not to largely move the hand in midair above the button 18, the instruction can be input by the gesture and the button 18 can be operated, and these operations can visually be checked without moving a line of sight to the floating image.

The present invention is not limited to the above embodiments, and various changes can be made without departing from the scope of the claims. That is, embodiments obtained by a combination of technical units that are properly changed without departing from the scope of the claims is also included in the technical scope of the present invention.

One or more embodiments of the present invention may suitably be applied to play machines such as a slot machine, a Poker game machine, a mah-jongg game machine, and a card game machine.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

The invention claimed is:

1. An operation device installed on a play machine, comprising:

a push button switch comprising a push button made of a translucent material;

a floating image projector that projects a floating image into midair above the push button through the push button from a rear face side of the push button; and a gesture detector in which at least a region where the floating image is projected is set to be a detection region, wherein the floating image projector comprises:

a planar liquid crystal device disposed perpendicular to an upper surface of a case, and a plate that redirects the image from the liquid crystal device disposed on the upper surface of the case so as to form an acute angle with the case, and wherein the liquid crystal device or the plate is adjustable in a direction parallel to the upper surface of the case.

2. The operation device according to claim 1, wherein the push button comprises a light guide plate, and wherein the push button switch comprises a light source configured to supply light to the light guide plate.

3. A play machine comprising:

an operation device installed on the play machine, comprising:

a push button switch comprising a push button made of a translucent material, a floating image projector that projects a floating image into midair above the push button through the push button from a rear face side of the push button, and a gesture detector in which at least a region where the floating image is projected is set to be a detection region; and a controller that controls the push button switch, the floating image projector, and the gesture detector, wherein the floating image projector comprises:

a planar liquid crystal device disposed perpendicular to an upper surface of a case, and a plate that redirects the image from the liquid crystal device disposed on the upper surface of the case so as to form an acute angle with the case, and wherein the liquid crystal device or the plate is adjustable in a direction parallel to the upper surface of the case.

4. The play machine according to claim 3, wherein the controller performs control while correlating the floating image of the floating image projector, a gesture detected by the gesture detector, and a push button pressing operation detected by the push button switch, with each other.

5. A play machine comprising:

an operation device installed on the play machine, comprising:

a push button switch comprising a push button made of a translucent material, a floating image projector that projects a floating image into midair above the push button through the push button from a rear face side of the push button, and a gesture detector in which at least a region where the floating image is projected is set to be a detection region; and a controller that controls the push button switch, the floating image projector, and the gesture detector, wherein the push button comprises a light guide plate, wherein the push button switch comprises a light source configured to supply light to the light guide plate, wherein the floating image projector comprises:

a planar liquid crystal device disposed perpendicular to an upper surface of a case, and a plate that redirects the image from the liquid crystal device disposed on the upper surface of the case so as to form an acute angle with the case, and wherein the liquid crystal device or the plate is adjustable in a direction parallel to the upper surface of the case.

6. The play machine according to claim 5, wherein the controller performs control while correlating the floating image of the floating image projector, a gesture detected by the gesture detector, and a push button pressing operation detected by the push button switch, with each other.

* * * * *